US005554090A

United States Patent [19]

Jones

[11] Patent Number: 5,554,090

[45] Date of Patent: Sep. 10, 1996

[54] CALF EXERCISE MACHINE

[75] Inventor: Gary A. Jones, Falmouth, Ky.

[73] Assignee: Hammer Strength Corporation, Cincinnati, Ohio

[21] Appl. No.: 367,467

[22] Filed: Dec. 30, 1994

[51] Int. Cl.[6] ..... A63B 21/06; A63B 23/08

[52] U.S. Cl. ..... 482/97; 482/98; 482/134; 482/137; 482/139

[58] Field of Search ..... 482/72, 79, 80, 482/92–94, 97, 98, 101, 133–139, 142, 146, 907, 908, 100, 145; D21/195; 601/34, 35

[56] References Cited

U.S. PATENT DOCUMENTS

| | | | |
|---|---|---|---|
| 4,621,810 | 11/1986 | Cummins | 482/104 |
| 4,822,038 | 4/1989 | Maag | 482/97 |
| 4,838,548 | 6/1989 | Maag | 482/137 |
| 5,106,081 | 4/1992 | Webb | 482/137 |
| 5,135,449 | 8/1992 | Jones | 482/134 |
| 5,263,914 | 11/1993 | Simonson et al. | 482/99 |
| 5,334,120 | 8/1994 | Rasmussen | 482/97 |
| 5,366,432 | 11/1994 | Habing et al. | 482/138 |
| 5,484,365 | 1/1996 | Jones et al. | 482/97 |

OTHER PUBLICATIONS

Body Masters Sports Industry Inc. advertisement in "Mr. America" program, Sep. 8, 1979.

*Primary Examiner*—Richard J. Apley
*Assistant Examiner*—Victor K. Hwang
*Attorney, Agent, or Firm*—Wood, Herron & Evans, P.L.L.

[57] ABSTRACT

An improved calf exercise machine includes a frame with a seat for supporting an exerciser in an exercise position with the legs extended horizontally, a lever pivotally connected to the frame in front of and below the seat, and an engagement plate secured to the lever and adapted to be engaged and acted upon by the upper portions of the feet of the exerciser via an outward toe extension movement followed by a rearward toe retraction motion. This movement arcuately rotates the lever about its pivot axis, with a corresponding flexion and then extension of the calf muscles. Weight holding hubs connected to the lever hold a selected number of weighted plates to provide a desired weight resistance to pivotal extension of the lever via the outwardly directed foot movement. This machine optimally isolates the calf muscles during calf flexion/extension. Additionally, this calf exercise machine is safer than prior calf exercise machines because the exercise motion is performed from a seated position, and the seat design minimizes wear and tear on the exerciser's body, due to improved distribution of the weight resistance exercised against.

18 Claims, 4 Drawing Sheets

CALF EXERCISE MACHINE

FIELD OF THE INVENTION

This invention relates to a strength training exercise machine, and more particularly to a calf exercise machine for performing a calf exercise from a seated position.

BACKGROUND OF THE INVENTION

Strength training, or weight training, has become tremendously popular within the past ten years. This is due primarily to the increased desire of people of all ages to stay fit by maintaining muscle tone, and the desire of some individuals within this group to also increase muscle bulk and/or strength.

Hammer Strength Corporation has succeeded in developing a line of innovative exercise machines which provide optimal muscular benefits during exercise by orienting the exercise motion along movement planes and/or arcs which most naturally accommodate the musculo-skeletal makeup of the human body. This success has been recognized by the U.S. Patent Office via issuance to this applicant of the following U.S. Pat. Nos.: D321,026; D321,027; D321028; D321,387; D321,389; D321,390; D321,391; 5,044,631; 5,044,632; 5,050,873; 5,066,003; 5,066,004; 5,106,080; 5,125,881; 5,135,449; 5,135,456; 5,171,198; 5,180,354; 5,181,896; 5,273,504; and 5,273,505. In addition to optimal muscular benefits, most of the commercial embodiments of these patented machines provide the "look and feel" of working out with free weights, but without the safety risks typically associated therewith.

Nevertheless, there still exists a need to improve upon the exercise mechanisms used to exercise certain muscle groups of the body, either because present mechanisms have proved ineffective for one reason or another or because safety issues have not been adequately addressed.

One such muscle group includes the calf muscles of the legs. The calf muscles are typically exercised by the exerciser by initiating a movement up on to the toes from a foot-horizontal position, thereby flexing the calf muscles. This initial movement is followed by lowering of the exerciser's heels back to a position horizontally even with the toes, thereby extending the calf muscles.

This calf exercise motion has been performed in the past on an exercise mechanism commonly referred to as a calf-raise machine. There are several different types of calf-raise exercise mechanisms. For each of these mechanisms, additional weight is added to the exerciser to make the calf flexion/extension movement more difficult, and better matched to the capabilities of the exerciser. For a calf-raise exercise mechanism referred to as a "donkey" calf raise, the additional weight that is exercised against is applied to the exerciser's hips, and the exerciser stands up but is bent forwardly during the exercise. For a calf-raise exercise mechanism referred to as an "erect" calf raise, the additional weight is applied to the exerciser's shoulders, and the exerciser stands straight up during the exercise. It has generally been thought that these mechanisms represent the best way to isolate the calf muscles during the calf flexion/extension motion for optimum muscular benefit.

However, with both of these mechanisms, the applied weight is placed not only on the exerciser's calves, but also on other parts of the body, such as the exerciser's lower back and hips. This extra weight applied to the lower back and hips of the exerciser and the entire back if performed from a standing position, helps the exerciser achieve optimum calf muscle exercise during the motion. However, this added weight places undue vertical compression upon the hips, the spinal column, or both. The added weight also compresses and bears directly against the body, via contact between the shoulders or the hips with a relatively small pad. Because many exercisers require the use of a relatively large amount of weight to adequately work the calf muscles, i.e., in many instances up to 700 or 800 pounds, or even up to 1,000 pounds, the vertical compression applied to the hips and/or the spinal column during calf exercise motion is significant. Moreover, the compressive forces due to the weight bearing directly against the body are also significant.

As a result of these factors, the present mechanisms for exercising the calves restrict the access of exercisers who are recuperating from a back injury, exercisers who may be physically handicapped, some elderly exercisers, or other exercisers who for one reason or another cannot bear the application of these compressive and direct forces on the body. Even for healthy persons involved with weight training, over a long period of time the adverse effects of the compressive and the direct forces on the body will eventually take their physical toll.

Another type of calf-raise exercise is referred to as the bent leg calf-raise mechanism. With this mechanism, the exerciser sits straight up, with legs bent, and weight resistance to the calf raising motion is applied to the tops of the knees and the thighs of the exerciser. However, like the above-described machines, with this machine the additional weight is borne directly by the exerciser, on the knees and thighs. This may cause extreme discomfort for the exerciser during performance of the exercise. Also, compared to the donkey and erect calf raises, the seated bent knee calf raise does not provide the same range of calf flexion and extension, because the legs remain bent during performance.

Applicant is also aware of another prior art calf exercise mechanism which was at one time sold by Nautilus, but then discontinued. With this machine, the calf exercise was performed from a seated position, with legs extended horizontally, and the upper portions of the feet of the exerciser contacted and pivoted a lever about an axis centered on the ball-and-socket joints of the ankle. It is applicant's understanding that this machine was very uncomfortable, and that this discomfort led to the eventual discontinuance of the machine. Apparently, use of a rigid hinge axis through the ball-and-socket joint of the ankles does not simulate the normal, or natural, flexion/extension motion of the calf.

Also, with respect to prior art, some exercisers have used a seated leg press to perform calf exercise, by simply initially extending the legs and then performing calf extension and flexion. However, this can be dangerous. If the feet slip off the engagement plate, the weight causes the plate to move toward the exerciser at high speed, often slamming into the exerciser's knees. Due to this safety problem, these machines do not represent an acceptable solution.

It is an objective of this invention to improve upon present calf exercise machines by reducing the wear on the body caused by vertical compression on the spine and the other compressive and direct forces which result from the additional weight often used by the exerciser to effectively exercise the calf muscles via the calf flexion/extension motion.

It is another objective of this invention to increase the accessibility of calf exercise machines, to include exercisers within a wide range of ages and physical abilities, without sacrificing the muscular benefits associated therewith.

It is still another objective of this invention to optimize the muscular benefits attainable with a calf exercise machine, while at the same time enhancing safety, for a wide variety of exercisers.

SUMMARY OF THE INVENTION

The above-stated objectives are achieved by an improved calf exercise machine which requires the exerciser to apply, from a seated position with the legs extended substantially horizontally, a pushing force via the balls of the feet against a pivotal lever that moves arcuately in a manner which naturally accommodates the flexion/extension motion of the calf muscles. The lever is weighted to provide a selected weight resistance, and the additional weight is borne by the back of the exerciser. However, this weight is borne with only minimal discomfort because of a two component cushion located behind the exerciser as a declined seat, which supports the back of the exerciser in the seated position and uniformly distributes the force applied to the exerciser. During exercise, the upper portion of the feet engage and move the pivotal lever, while the rest of the exerciser's body remains stationary.

Because a selected weight resistance can be applied to the lever, the exerciser can exercise the calf muscles against a desired weight resistance without the adverse effects caused by vertical compression on the hips and/or the spinal column. Moreover, the compressive forces borne directly by the body place only minimal wear and tear on the body. This is true regardless of how much weight is exercised against during the calf flexion/extension motion with the machine, due to the even distribution to the back of the exerciser of the added weight.

For these reasons, this improved exercise machine represents an improvement over prior machines because it may be used safely by exercisers in a much wider range of ages and physical abilities. For all exercisers using this improved calf exercise machine, optimum muscular benefits will be attainable with enhanced safety. Stated another way, with respect to working the calf muscles, this improved calf exercise achieves the primary objective of all weight training devices or mechanisms, safe results.

This invention also feels more natural to the exerciser because the hinge axis of the lever is located below and in front of the seat, and it is offset below and slightly behind an imaginary axis through the ball-and-socket joints of the ankle of the exerciser.

According to a preferred embodiment of the invention, an improved calf exercise machine includes a frame with a seat adapted to support an exerciser in a seated, upright position, with the legs extended horizontally. The seat includes back and bottom support members, and the seat is adjustable to accommodate exercisers with different leg lengths. The back support member has two separately angled sections. Also, the back support member is about four inches in thickness and includes an outer layer of high impact foam, referred to as "TEMPER" foam, with standard foam located behind thereof. This two-foam composition molds to the exerciser's back to promote better distribution of the force applied to the exerciser during the exercise.

A lever is pivotally connected to the frame in front of the seat, and the pivot axis of the lever is located in front of and below the exerciser when in the seated position. The lever has a force responsive plate rigidly secured thereto, and the plate is adapted to be acted upon by the balls of the feet of the seated exerciser. The plate includes two angled sections, each one adapted to be engaged by the upper portion of one of the feet of the exerciser. The angling of these sections better accommodates the natural orientation of the feet of an exerciser when seated with the legs extended horizontally. This further promotes the natural "feel" of this inventive exercise machine. On each side of the seat, an extender also connects to the lever and includes a weight holding hub, which is adapted to hold a selected number of weight plates to provide a desired weight resistance to pivotal movement about the pivot axis of the lever.

With the exerciser positioned upon the bottom support member and leaning rearwardly against the two-component back support member, and with the legs extended horizontally to place the balls of the feet against the plate, the exerciser applies a forward pressing motion with the toes and the balls of the feet. This forward pressing motion flexes the calf muscles of the exerciser's legs, as the plate and the other lever components rotate arcuately about the lever pivot axis. The force applied by the exerciser must be greater than the weight resistance held by the hubs. When the toes are extended as far forwardly as possible, the forward rotational movement of the lever is complete. Thereafter, retraction of the toes from their outermost position allows the lever to rotate back to its starting position, as the calves of the exerciser undergo extension. Thus, arcuate extension and retraction of the toes of the exerciser produce a corresponding flexion and extension in the calf muscles of the exerciser, with the selected weight resistance at all times being applied in an isolated manner against the calves. Also, the pivot axis is offset from the ball-and-socket joint of the ankle.

This relationship optimizes the muscular benefits obtainable by an exerciser via performance of a calf flexion/extension exercise motion. Additionally, because the exercise motion is performed from a seated position with legs extended horizontally, and because of the uniform distribution of force on the exerciser while in this position, the application of a weight resistance against the calves during the exercise motion, regardless of the amount of weight, optimally minimizes the adverse physical consequences on the exerciser. Stated another way, the compressive and direct forces on the exerciser are distributed in a way which minimizes wear and tear on the exerciser's body.

These and other features of the invention will be more readily understood in view of the following detailed description and the drawings.

DETAILED DESCRIPTION OF THE INVENTION

Figure 1:
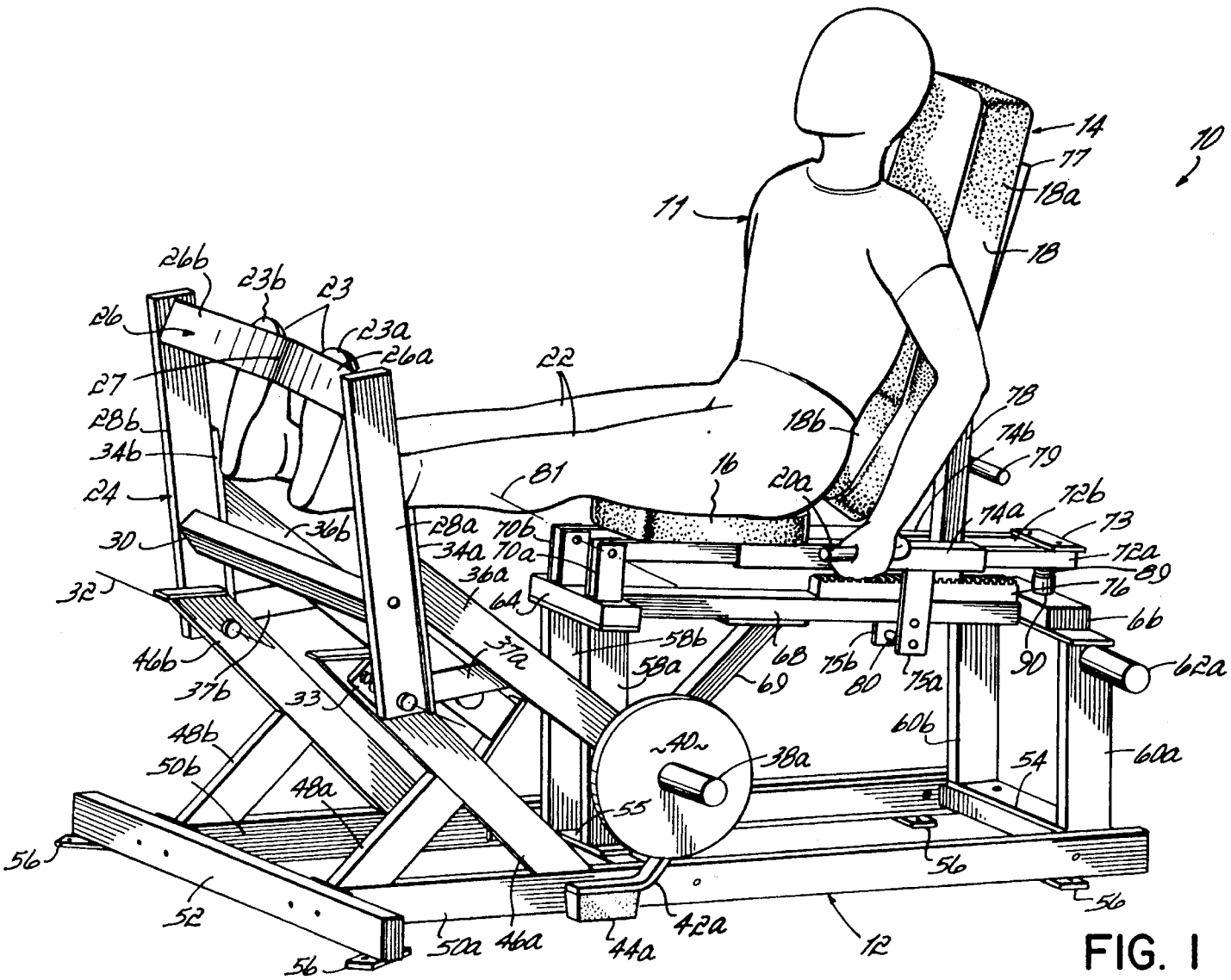
FIG. 1 is a perspective view of an improved calf exercise machine constructed in accordance with a preferred embodiment of the invention.
Figure 2:
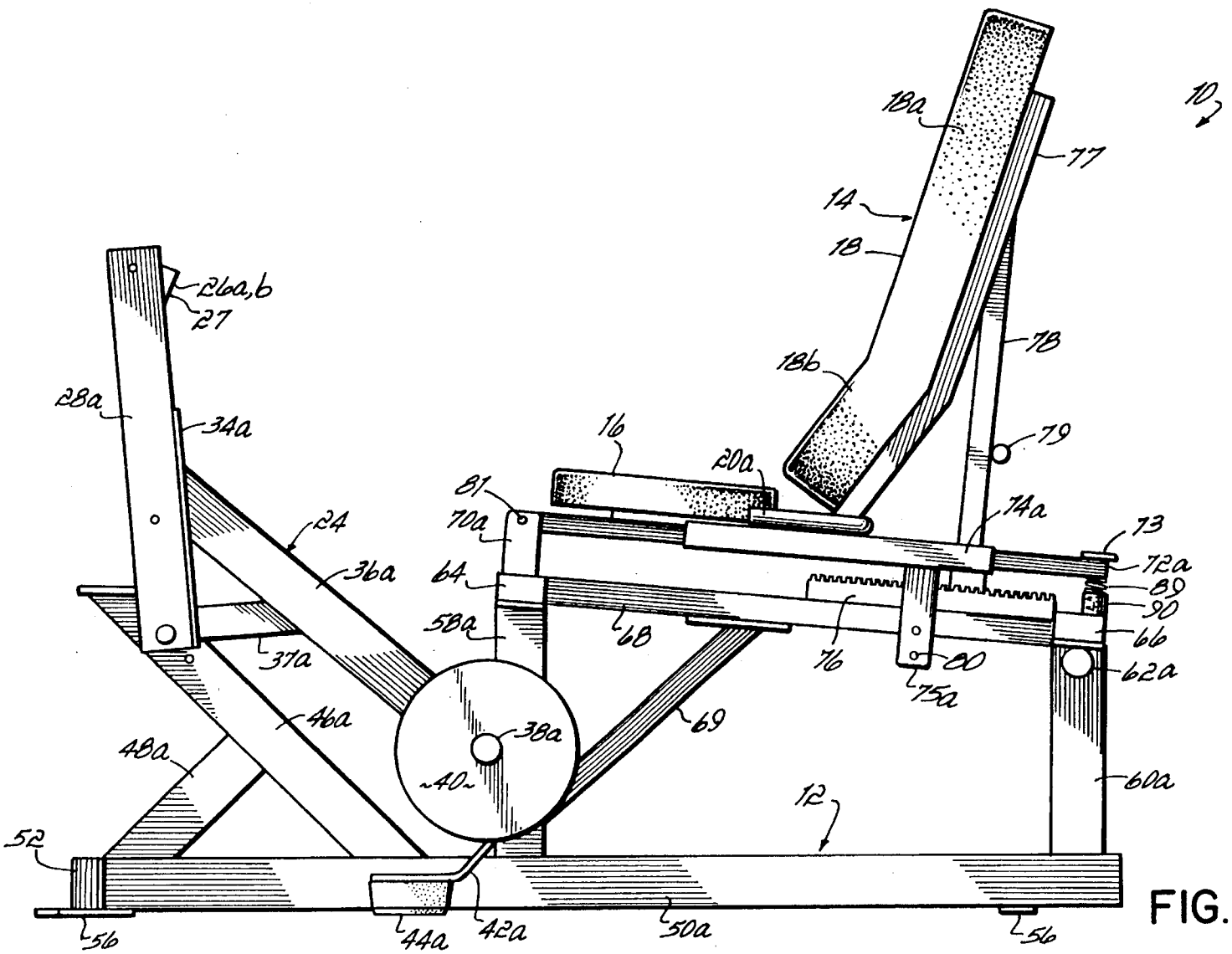
FIG. 2 is a side view of the improved calf exercise machine shown in FIG. 1.
Figure 3:
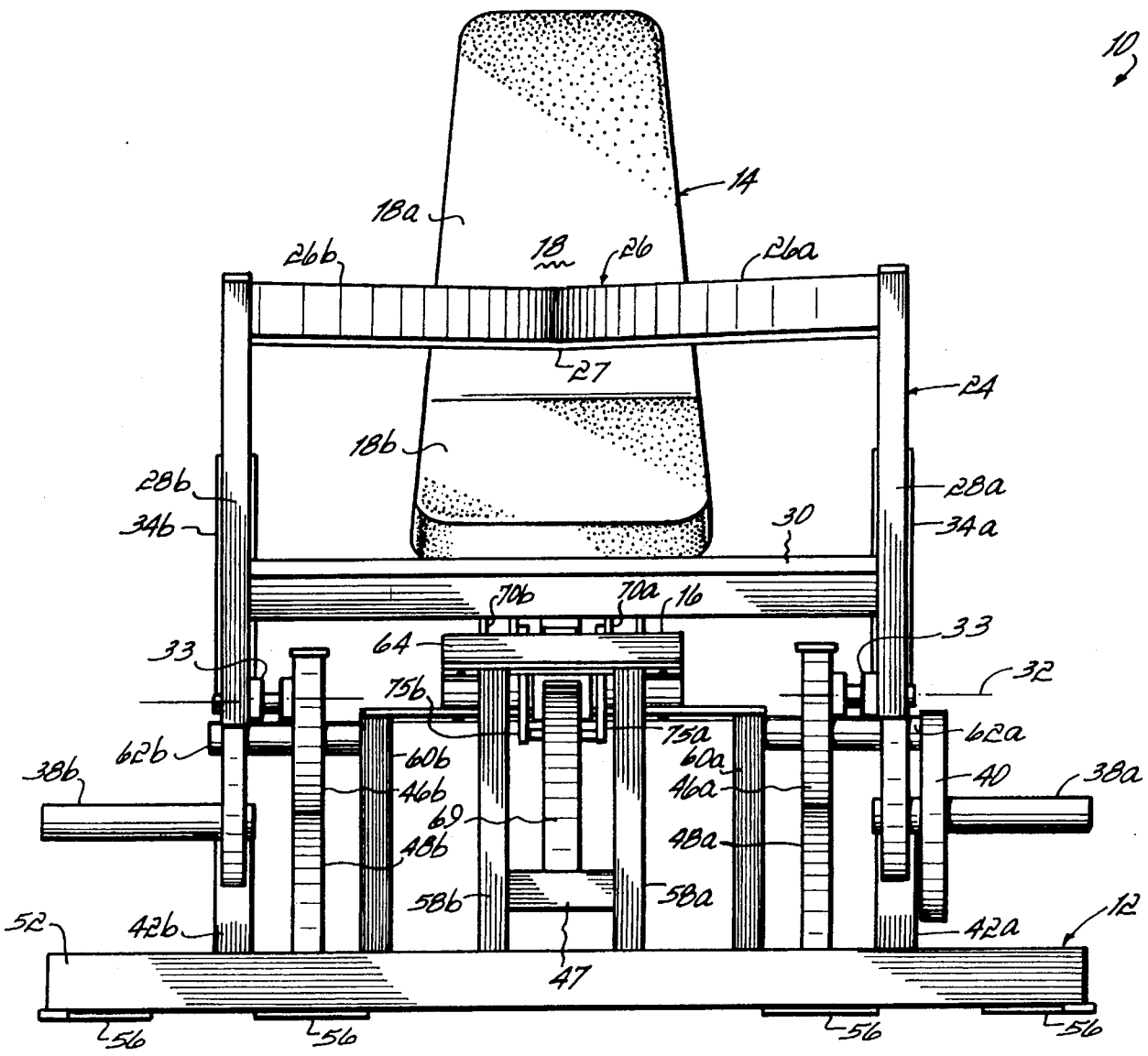
FIG. 3 is a front view of the improved calf exercise machine shown in FIG. 1.

FIGS. 1 through 4 show an improved calf exercise machine 10 constructed in accordance with a preferred embodiment of the invention. This exercise machine 10 is adapted to be used by an exerciser 11 to exercise the calf muscles via a flexion/extension motion from a seated position, with the legs extended horizontally. The structure and orientation of the components of this machine 10 represent an improvement over prior calf machines because the exerciser 11 is able to optimally isolate the calf muscles during this flexion/extension motion, while at the same time, no compressive force is applied to the hips and/or the spinal column of the exerciser 11. Because of these features, this improved calf exercise machine 10 achieves the primary objective of all weight training exercise machines, safe results for the exerciser 11.

This improved calf exercise machine 10 comprises a frame 12 made up of a number of bent and/or connected components, primarily metal components to provide the necessary structural integrity and to withstand the environment of typical weight training facilities. The component parts of the frame 12 are welded and/or secured together in a manner consistent with known practice in the industry, as set forth in prior patents issued to this same inventor, which were identified previously.

More particularly, the frame 12 includes a seat, designated generally by numeral 14. The seat 14 includes a bottom support member 16 and a back support member 18 rigidly connected thereto. The bottom support member 16 is oriented substantially horizontally, but with a preferable rearward and downward tilt of a few degrees. It may be of any standard foam material, encased within an outer vinyl layer. The back support member 18 is substantially perpendicular to the bottom support member 16, though it declines rearwardly therefrom at a slight angle, and it includes two sections 18*a* and 18*b* oriented at different angles, as shown best in FIG. 2. Both sections 18*a* and 18*b* include a two-component foam construction, with a bottom two inch layer of standard foam covered by another two inch layer of high impact, or "TEMPER", foam, and both layers encased within vinyl.

Figure 4:
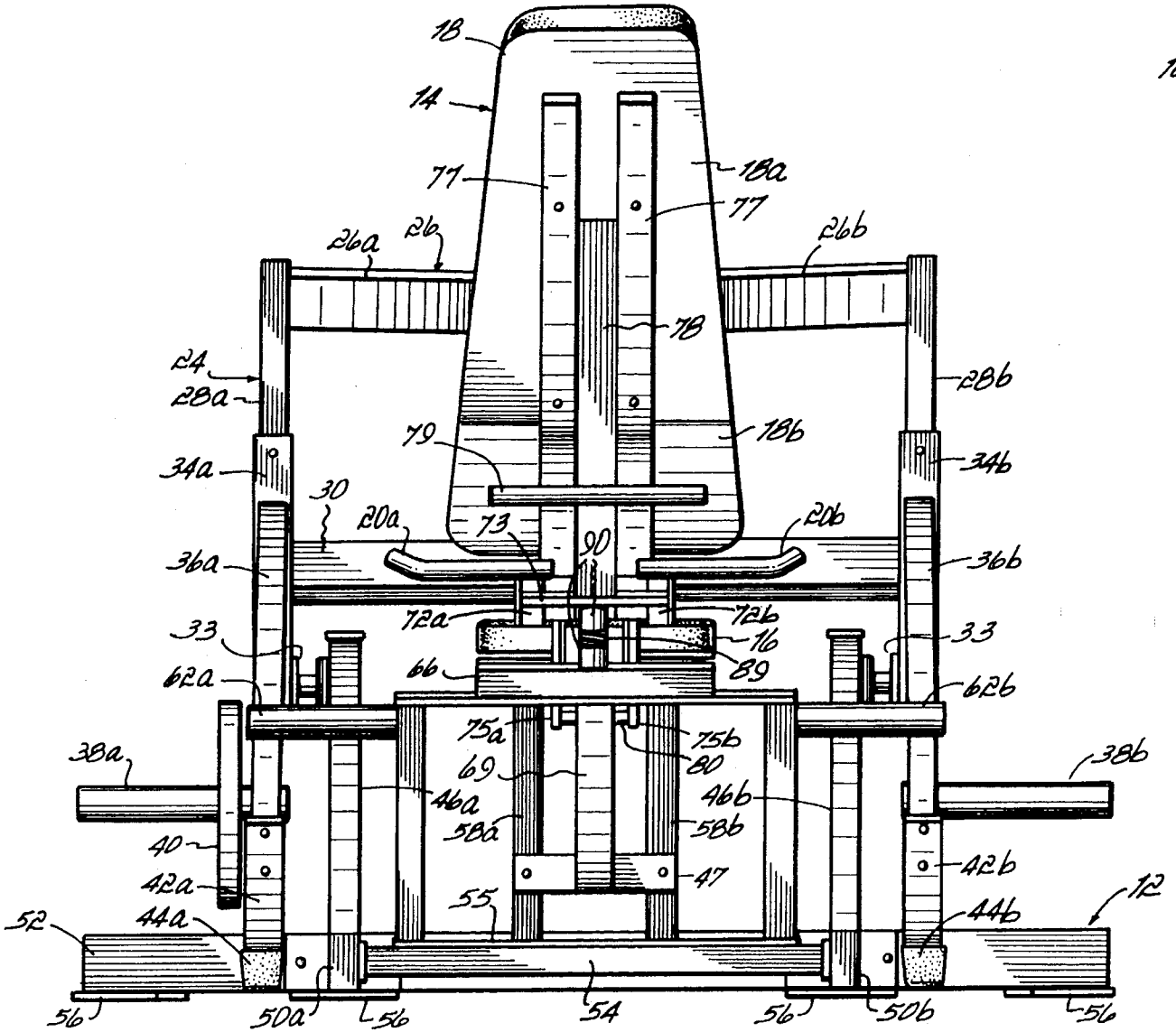
FIG. 4 is a rear view of the improved calf exercise machine shown in FIG. 1

This two-foam construction of high impact foam and regular foam enables the back support 18 to mold in conformance to the shape of the exerciser's back. As a result, in use, the force borne by the exerciser due to the weight on the lever is more evenly distributed over a large surface area, so that the exerciser 11 experiences a minimum of wear and tear on the body. The seat 14 is adjustable to accommodate exercisers 11 having legs 22 of different length. The seat 14 also includes handles 20*a* and 20*b* located on opposite sides of the back support member 18 (FIG. 4).

When the exerciser 11 is supported on the seat 14 in an exercise position defined thereby, and facing a forward direction with the legs 22 extended substantially horizontally, or extending outwardly in an unbent condition, the feet 23 of the exerciser 11 are oriented upwardly, and ready to engage a lever, designated generally by reference numeral 24. The lever 24 is pivotally connected to the frame 12 forward of the seat 14. More specifically, the upper portions of the feet 23, i.e. the toes and the balls of the feet, bear against an engagement plate 26 which is secured to the pivotal lever 24. The engagement plate 26 includes a central bend 27 which defines two portions angled with respect to each other. These portions are designated left portion 26*a* and right portion 26*b*, and these portions are adapted to be acted upon by the left and right feet 23*a* and 23*b*, respectively, of the exerciser 11. The bend 27 places the left portion 26*a* and the right portion 26*b* in an initial "neutral" position, with no stress on the ankles or feet of the exerciser 11. This better accommodates the natural musculoskeletal makeup of the exerciser 11.

A pair of spaced uprights 28*a* and 28*b* have upper ends secured to the opposite ends of the engagement plate 26. Below the engagement plate 26, the uprights 28*a* and 28*b* are interconnected via a brace 30 which is oriented substantially horizontal. Lower ends of the uprights 28*a* and 28*b* are connected to the frame 12 along, or in alignment with, a pivot axis 32 about which the lever 24 may be pivotally moved. At all times during pivotal movement, the heels of the exerciser 11 remain substantially between the pivot axis 32 and the engagement plate 26. The pivot axis 32 is oriented perpendicular to the forward facing direction of the exerciser 11 and is also located forward of and below the seat 14. The pivot axis 32 is offset from an imaginary axis through the ball-and-socket joint of an exerciser 11. Specifically, the pivot axis 32 is located below and slightly behind this imaginary axis. The bottom ends of the uprights 28*a* and 28*b* are connected to the frame 12 via bearings 33 (FIG. 3), which may be a bearing sold by SST under the Model No. FTN 205D, or a functionally equivalent bearing of the type disclosed and described in applicant's other issued U.S. Patents, namely a pillow block bearing sold by Browning under Part No. VF2S which requires one shot of lubricating oil per year.

A pair of securement plates 34*a* and 34*b* are rigidly secured to the rearward surfaces of the uprights 28*a* and 28*b*, respectively. Extenders 36*a* and 36*b* secure to the securement plates 34*a* and 34*b*, respectively, and extend downwardly and rearwardly therefrom. On each side of the frame 12, extender braces 37*a* and 37*b* provide additional support for the extenders 36*a* and 36*b*, respectively. At the bottom ends of the extenders 36*a* and 36*b*, the frame 12 includes hubs 38*a* and 38*b*, respectively. Each of the hubs 38*a* or 38*b* is adapted to hold a selected number of weighted plates 40. The weighted plates 40 provide a selected weight resistance which resists pivotal movement of the lever 24 about the pivot axis 32 when the feet 23 of the exerciser 11 are extended forwardly. Thus, the total weight resistance resulting from the weighted plates 40 dictates the degree of difficulty for the exerciser 11 in performing the arcuate toe extension/retraction motion which corresponds to calf flexion/extension. If desired, instead of hubs 38 and weight plates 40, a predetermined weight resistance may be coupled to the lever 24 via use of a pulley or chain mechanism which includes a cam and a selectorized weight stack.

On each side of the frame 12, the extender 36*a* or 36*b* includes a downwardly extending stop arm 42*a* or 42*b*, respectively, with a stop pad 44*a* or 44*b* secured thereto. This stop arm and stop pad serve as a stop mechanism for restricting further downward pivotal movement of the hub 38 with respect to the pivot axis 32. Stated another way, the stopping mechanism dictates the initial, at rest, position of the lever 24, as shown best in FIG. 2.

The bottom ends of the uprights 28*a* and 28*b* are pivotally connected to forward legs 46*a* and 46*b*, respectively, both of which are oriented diagonally. Forward legs 46*a* and 46*b* are held in position by forward leg braces 48*a* and 48*b*, respectively. The bottom ends of these forward legs 46*a* and 46*b* and forward leg braces 48*a* and 48*b* are secured to bottom side sections 50*a* and 50*b*. The front ends of the bottom side sections 50*a* and 50*b* secure to the bottom front section 52, and rearward ends thereof secured to a bottom rear section 54. Mounting plates 56 secure to the outer ends of the bottom front section 52 and the bottom rear section 54.

Rearward of this lever support structure, the frame 12 includes seat supporting structure. More specifically, the frame 12 includes seat front legs 58*a* and 58*b* and seat rear legs 60*a* and 60*b*. The seat rear legs 60*a* and 60*b* support rear weight holding horns 62*a* and 62*b*, respectively, for holding additional weighted plates 40 when not in use. These weight holding horns 62*a* and 62*b* provide an additional convenience feature for this exercise machine 10, and they are optional.

A front cross brace 64 spans the upper ends of front seat legs 58*a* and 58*b*, while a rear cross brace 66 spans the upper ends of rear legs 60*a* and 60*b*. A longitudinal seat mounting member 68 extends between the front and rear cross braces 64 and 66. Additionally, a diagonal seat mounting brace 69 provides additional support for longitudinal seat mounting member 68. The bottom end of seat mounting brace 69 connects to front legs 58*a* and 58*b* by cross member 47 (FIGS. 3 and 4) and front legs 58*a*, 58*b* connect to a bottom center Section 55 for support. A pair of upwardly extending mounting brackets 70*a* and 70*b* are supported on front cross brace 64. These brackets 70*a* and 70*b* support longitudinal slides 72*a* and 72*b*, and the bottom support member 16 is slidable with respect to the slides 72*a* and 72*b*. At the rearward end of the frame 12, the slide members 72*a* and 72*b* are spanned by a connector 73.

Thus, both components of the seat 14, the bottom support member 16 and the back support member 18, are adjustable longitudinally along longitudinal seat mounting member 68 and slide members 72*a* and 72*b*. To accomplish this, reinforcing structure for the back support member 18 includes a rear support backplate 77 which is in turn connected to a rear brace 78, the bottom end of which is toothed to mesh with the corresponding teeth of a toothed member 76 mounted to the upper surface of longitudinal seat mounting member 68. The seat 14 also includes guide members 74*a* and 74*b* which are slidable along slide members 72*a* and 72*b*, respectively. A guide member bracket, comprising downwardly extending guide members 75*a* and 75*b* and a member 80 which spans therebetween, prevents inadvertent upward lifting of the seat 14 with respect to the frame 12 beyond a distance of several inches.

To facilitate adjustability of the seat 14, the rear brace 78 includes a horizontally oriented handle 79 for rotatably lifting the teeth of brace 78 out of engagement with toothed member 76. This lifting pivots the guide members 72*a* and 72*b* about an axis 81 (FIG. 2), and allows the bottom support member 16 and the back support member 18 to be moved together to a desired position. Thereafter, lowering the handle 79 causes the teeth to engage and to fix the position of the seat 14 relative to the frame 12. A spring 89 attached to the bottom side of connector 73 engages brace 66 to prevent the seat 14 from slamming down. The spring 89 is centered on a mount 90.

To use this improved calf exercise machine 10, the exerciser 11 adjusts the seat 14 with respect to the frame 12 to accommodate the length of his or her legs 22. With a selected number of weighted plates 40 held on hubs 38*a* and/or 38*b*, the exerciser 11 locates himself or herself in a seated exercise position facing forwardly, with the lever 24 forward of the exercise position.

With the toes and the balls of the feet 23 bearing against the engagement plate 26, the exerciser arcuately extends the feet in a forward direction. This forward extension motion causes pivotal movement of the lever 24 with respect to the frame 12 about pivot axis 32, against the selected weight resistance. This forward extension of the toes and balls of the feet also corresponds to flexion of the calf muscles of the exerciser 11.

After the toes are fully extended at the forward end of this forward extension motion, the exerciser 11 retracts them rearwardly. This corresponds to extension of the calf muscles as the lever 24 pivots about its pivot axis 32 back to its initial at rest position. During the entire extension and retraction movement of the feet, which produces flexion and extension of the calf muscles, the weight resistance supplied to the lever 24 by the weighted plates, and the weight of the other lever components, is applied directly to the calf muscles. Stated another way, the calf muscles are optimally isolated during this calf exercise motion. Nevertheless, because the exercise is performed from a seated position, with back support 18 providing firm molded support for the back of the exerciser 11, the weight worked against by the calf muscles is uniformly distributed over a large surface area of the exerciser's back. As a result, the exerciser 11 does not experience any vertical compression on the hips and/or the spinal column, as with the prior "donkey" and "erect" calf exercise machines, and experiences only minimal wear on the body from direct and compressive forces resulting from the added weight.

Additionally, because the lever 24 moves arcuately with respect to the frame 12, this machine 10 more naturally accommodates the extension and retraction motion of the feet 23 of an exerciser 11. This is because extension of the toes and the balls of the feet of an exerciser is arcuately performed about a pivot axis 32 which is slightly offset from an imaginary axis through the ball-and-socket ankle joints of the exerciser 11. Due to the use of a pivotally connected lever 24 which applies weight resistance to the feet 23 along this arcuate path, and the natural in-turn of the foot engagement plate portions 26*a* and 26*b*, the selected weight resistance bears against the calves in a direction which better accommodates the natural motion of the exerciser 11.

Unlike present seated leg press exercise machines which are primarily adapted for a leg press exercise motion but which may also be used to perform toe extension/retraction to result in a corresponding calf flexion/extension, this invention does not place the exerciser at risk when performing the exercise. If the feet slip, the engagement plate 26 only rotates a small distance toward the exerciser 11.

Thus, this invention uses a weighted lever to achieve calf flexion/extension from a seated back-supported position with legs extended horizontally, thereby providing a significant improvement over the prior calf exercise machines or leg press machines used for calf exercise. This invention achieves these improvements because it more closely accommodates the natural hinged movement of the exerciser during the calf flexion/extension motion, and because it significantly improves safety, for a wide variety of exercisers.

While these and other features of an improved calf exercise machine in accordance with the preferred embodiment of the invention have been described, it is to be understood that the invention is not limited thereby and that in light of the present disclosure, various other alternative embodiments will be readily apparent to one of ordinary skill in the art without departing from the scope of the invention. Accordingly, applicant intends to be bound only by the following claims.

I claim:

1. A calf exercise machine comprising:

a frame;

support means connected to the frame for supporting an exerciser in a seated exercise position with the legs of the exerciser extending in a direction along a length of the machine;

lever means pivotally connected to the frame forward of the support means for rotating with respect to the frame about a substantially horizontal pivot axis oriented perpendicular to the length of the machine;

engagement means secured to one end of the lever means and having a bend extending toward the support means, and providing two distinct engagement portions the engagement means being adapted to be engaged and acted upon by ball and toe portions of soles of feet of an exerciser when in the exercise position, wherein the exerciser arcuately pivots the lever means about the pivot axis by extending and retracting the ball and retracting the ball and toe portions of the feet, resulting in a corresponding flexion/extension of the calf muscle of the exerciser; and weight holding means connected to the lever means for providing a selected weight resistance to pivotal motion of the lever means during flexion of the calf muscle by the exerciser.

2. The calf exercise machine of claim 1 wherein the pivot axis resides below the support means.

3. The calf exercise machine of claim 1 wherein the means is a seat having a back support declined from vertical and a bottom support inclinded from the horizontal.

4. The calf exercise machine of claim 1 wherein the weight holding means further comprises:

a hub adapted to hold a selected number of weighted plates to achieve the selected weight resistance.

5. The calf exercise machine of claim 1 wherein the engagement means is declined from vertical.

6. A calf exercise machine comprising:

a frame;

a seat connected to the frame and adapted to support an exerciser with the legs of the exerciser extending along a length of the machine;

a lever connected to the frame to pivot about a substantially horizontal pivot axis oriented substantially perpendicular to the length of the machine;

a weight support connected to the lever to support weights, the weight support providing a selectable resistance to pivotal motion of the lever; and an engagement plate connected to the lever, the engagement plate having a bend extending toward the seat, and providing two distinct engagement portions the engagement plate being adapted to receive ball and toe portions of soles of feet of the exerciser, wherein the exerciser flexes and extends calf muscles to correspondingly extend and retract the ball and toe portions of the feet and arcuately pivot the lever about the pivot axis against the selectable resistance.

7. The calf exercise machine of claim 6 wherein the pivot axis is located below the seat.

8. The calf exercise machine of claim 7 wherein the engagement plate is located above the pivot axis.

9. The calf exercise machine of claim 8 wherein the weight support is located below the pivot axis.

10. The calf exercise machine of claim 9 wherein the seat includes a bottom support connected to a back support, wherein the bottom and back supports are adapted to support the exerciser in a seated exercise position with the legs extending substantially horizontally and the heels of the exerciser in the exercise position remain at all times below the ball and toe portions of the feet and the pivot axis.

11. A calf exercise machine comprising:

a frame;

a seat connected to the frame and adapted to support an exerciser in a seated exercise position with the legs of the exerciser extending in a direction along a length of the machine;

a lever pivotally connected to the frame and being pivotal about a substantially horizontal pivot axis oriented substantially perpendicular to the length of the machine, the pivot axis being located forward of and below the seat, the lever being arcuately pivotal between first and second positions, the first position being closer to the seat than the second position;

an engagement plate secured to the lever above the pivot axis, the engagement plate having a bend extending toward the seat and providing two distinct engagement portions and the engagement plate being adapted to receive ball and toe portions of a sole of a foot of the exerciser when in the exercise position, wherein the exerciser arcuately pivots the lever about the pivot axis by extending and retracting the ball and toe portions of the foot resulting in a corresponding flexion/extension of the calf muscles of the exerciser; and a weight support connected to the lever for providing a selectable resistance to pivotal movement of the lever between the first and second positions.

12. The calf exercise machine of claim 1 wherein the seat further comprises:

a horizontal bottom support member; and a back support member.

13. The calf exercise machine of claim 12 wherein the seat is adjustable along the length of the machine to accommodate exercisers having different leg lengths.

14. The calf exercise machine of claim 11 wherein the lever further comprises:

a pair of spaced uprights, each of the uprights having an upper end above the pivot axis secured to one end of the engagement plate, and a lower end pivotally connected to the frame with to rotate about the pivot axis.

15. The calf exercise machine of claim 14 wherein the weight support further comprises:

a pair of spaced extenders, each of the extenders being connected to one of the uprights on opposite sides of the seat;

a pair of hubs, each hub being secured to an extender and adapted to hold selected weights to provide the selectable resistance.

16. The calf exercise machine of claim 15 wherein the extenders extend downwardly from the uprights and toward the seat to locate the hubs on opposite sides of the seat below the pivot axis.

17. The calf exercise machine of claim 11 wherein the engagement plate is angled downwardly from vertical toward the seat when the lever is in the at rest position.

18. The calf exercise machine of claim 11 and further comprising:

a stop operatively to restrict rotational movement of the lever about the pivot axis, and to define the first position for the lever.

* * * * *

UNITED STATES PATENT AND TRADEMARK OFFICE

CERTIFICATE OF CORRECTION

PATENT NO. : 5,554,090
DATED : September 10, 1996
INVENTOR(S) : Gary A. Jones

It is certified that error appears in the above-indentified patent and that said Letters Patent is hereby corrected as shown below:

Col. 9, line 8, "and retracting the ball" should be deleted.

Col. 9, line 18, before "means" insert --support--.

Col. 10, line 27, "claim 1" should read --claim 11--.

Col. 10, line 39, "with" should be deleted after "pivotally connected to the frame".

Col. 10, line 55, "at rest" should read --first--.

Col. 10, line 58, after "a stop operatively", insert --associated with the lever--.

Signed and Sealed this

Eighteenth Day of March, 1997

Bruce Lehman

*Attest:*

BRUCE LEHMAN

*Attesting Officer*

*Commissioner of Patents and Trademarks*